US005662257A

United States Patent [19]

Mukoyama et al.

[11] Patent Number: 5,662,257

[45] Date of Patent: Sep. 2, 1997

[54] NAILING MACHINE

[75] Inventors: Kenji Mukoyama; Noriaki Hayashi, both of Anjo, Japan

[73] Assignee: Makita Corporation, Anjo, Japan

[21] Appl. No.: 402,528

[22] Filed: Mar. 10, 1995

[30] Foreign Application Priority Data

Mar. 11, 1994 [JP] Japan ..... 6-041404

[51] Int. Cl.[6] ..... B25C 1/04

[52] U.S. Cl. ..... 227/8; 227/130

[58] Field of Search ..... 227/8, 130, 120, 227/142

[56] References Cited

U.S. PATENT DOCUMENTS

| | | | |
|---|---|---|---|
| 4,351,464 | 9/1982 | Fehrs et al. | 227/8 |
| 4,523,646 | 6/1985 | Doyle et al. | 227/8 |
| 5,174,485 | 12/1992 | Meyer | 227/8 |
| 5,180,091 | 1/1993 | Ota . | |
| 5,219,110 | 6/1993 | Mukoyama | 227/8 |
| 5,263,626 | 11/1993 | Howard et al. | 227/8 |
| 5,350,103 | 9/1994 | Monacelli | 227/8 |

FOREIGN PATENT DOCUMENTS

| | | | |
|---|---|---|---|
| 2443544 | 3/1976 | Germany | 227/8 |
| 2700949 | 7/1978 | Germany | 227/8 |
| 4-133580 | 12/1992 | Japan . | |

*Primary Examiner*—Rinaldi I. Rada
*Assistant Examiner*—Boyer Ashley
*Attorney, Agent, or Firm*—Dennison, Meserole, Pollack & Scheiner

[57] ABSTRACT

A nailing machine includes a body, a driver extending downwardly from said body and vertically reciprocally movable for driving nails, and a driver guide for guiding the driver. A contact arm is movable between a lower first position and an upper second position and has a lower end for abutment on a work. The driver guide and the contact arm are fixed to each other and cooperate with each other to form a nail driving channel through which the nails are driven into the work.

8 Claims, 11 Drawing Sheets

NAILING MACHINE

BACKGROUND OF THE INVENTION

1. Field of the Invention

The present invention relates to a nailing machine.

2. Description of the Prior Art

A conventional nailing machine is operable to drive nails stored in a magazine one after another from a lower end of a driver guide by means of a driver driven by compressed air. The nails are stored in series within the magazine. A contact arm is provided for preventing an accidental driving of the nails when a nailing operation is not performed. Unless the contact arm is moved upwardly through abutment on a work, the driver may not be driven even if a trigger is turned on.

Such a conventional nailing machine is disclosed in Japanese Laid-Open Utility Model Publication No. 4-133580. The nailing machine of this publication is adapted to drive nails for finishing purposes and includes a driver guide and a plate-like contact arm which confronts the driver guide by a separation plane extending in a longitudinal direction of the driver guide. The driver guide and the contact arm cooperate to form a nail driving passage therebetween. The driver guide extends downwardly from a body of the nailing machine. The contact arm is vertically slidable relative to the driver guide and is biased downwardly by a spring. The contact arm is normally held in a position where a lower end of the contact arm extends downwardly from the driver guide by a predetermined distance.

With the nailing machine of Japanese Laid-Open Utility Model Publication No. 4-133580, when a trigger is pulled or turned on, the nails are ejected from a lower end of the driver guide through the nail driving passage and are then driven into a work, on the condition that the contact arm is pressed on the work and is moved upwardly relative to the driver guide by a predetermined distance. The driving depth of the nails can be adjusted by varying an upper stroke end of the contact arm.

Thus, with the nailing machine of this publication, since the nail driving passage is formed between the fixed driver guide and the contact arm which is movable vertically relative to the driver guide, the lower end of the contact arm may be positioned downwardly of the lower end of the driver guide, depending on the determined driving depth, even if the contact arm has been moved to its upper stroke end. In this case, the nails are not guided between the lower ends of the driver guide and the contact arm. This means that the nails are not guided just before they are driven into the work, so that the driving distance of the nails becomes unstable and the nails cannot be driven into the work at aimed positions.

SUMMARY OF THE INVENTION

It is, accordingly, an object of the present invention to provide a nailing machine which permits nails to be driven into a work at exact aimed positions.

It is also an object of the present invention to provide a nailing machine which provides a complete nail driving passage throughout a driving path of nails.

According to the present invention, there is provided a nailing machine comprising:

a body;

a driver extending downwardly from the body and vertically reciprocally movable for driving nails;

a driver guide for guiding the driver; and a contact arm movable between a lower first position and an upper second position and having a lower end for abutment on a work;

the driver guide and the contact arm being fixed to each other and cooperating with each other to form a nail driving channel through which the nails are driven into the work.

The invention will become more apparent from the appended claims and the description as it proceeds in connection with the drawings.

BRIEF DESCRIPTION OF THE DRAWINGS

FIG. 5(*b*) is a sectional view taken along line Vb—Vb in FIG. 4;

FIG. 5(*c*) is a sectional view taken along line Vc—Vc in FIG. 4;

FIG. 5(*d*) is a sectional view taken along line Vd—Vd in FIG. 4;

FIG. 9(*b*) is a sectional view taken along line IXb—IXb in FIG. 9(*a*);

FIG. 13(*b*) is a sectional view taken along line XIIIb—XIIIb in FIG. 12;

FIG. 14(*b*) is a view similar to FIG. 14(*a*) but showing a driver and a contact arm of the conventional nailing machine.

DETAILED DESCRIPTION OF THE PREFERRED EMBODIMENT

An embodiment of the present invention will now be explained with reference to the accompanying drawings.

Figure 1:
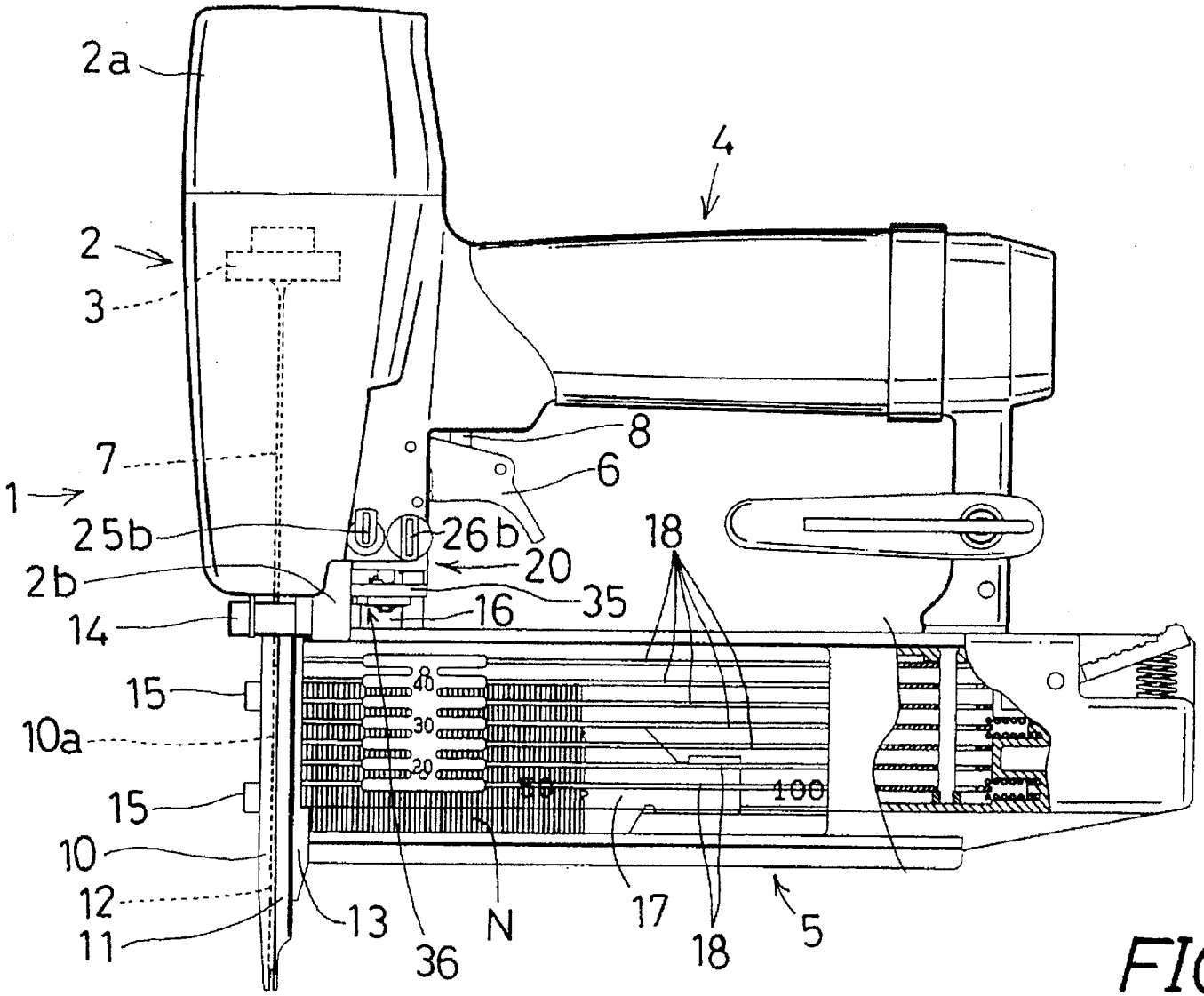
FIG. 1 is a left side view of a nailing machine according to an embodiment of the present invention.

Referring to FIG. 1, there is shown the whole construction of a nailing machine 1. The nailing machine 1 generally comprises a substantially cylindrical body 2, a driver guide 10, a handle 4 and a magazine 5. A piston 3 is disposed within the body 2 and is reciprocally driven by compressed air. The driver guide 10 is mounted on a lower end of the body 2 and extends downwardly therefrom. The handle 4 is mounted on a rear side of the body 2 and extends substantially perpendicular to the body 2. The magazine 5 is positioned in parallel to the handle 4 and has a front end connected to a guide recess 10*a* formed in the driver guide 10. The magazine 5 stores nails therein which are connected in series with each other. The magazine 5 is operable to supply the nails into the guide recess 6*a* one after another.

A trigger 6 is mounted on the handle 4 at a position adjacent the body 2 and is operable by an operator to open and close a trigger valve 8. The trigger 6 is normally held in an OFF position for closing the trigger valve 8 and is moved to an ON position for opening the trigger valve 8 when the operator pulls the trigger 6. When the trigger valve 8 is opened, the compressed air supplied from a compressed air source (not shown) enters the body 2 through a head valve (not shown) disposed within an upper portion of the body so that the piston 3 is moved by the compressed air. Then, a driver 7 connected to the piston 3 is moved downwardly under the guide of the guide recess 10*a*, so that the nails supplied into the guide recess 10*a* are driven out from the lower end of the driver guide 10 one after another (through a nail driving passage 12 which will be explained later). The handle 4 includes therein an air chamber (not shown) which is connected to the compressed air source by means of a hose (not shown) which in turn is connected to a rear end of the handle 4. Thus, when the trigger valve 8 is opened, the head valve is opened to permit the compressed air to enter the body 2.

The driver guide 10 has a substantially flat plate-like configuration and is fixed in face-to-face relationship with a contact arm 11 having a configuration similar to the driver guide 10, so that the driver guide 10 is movable together with the contact arm 11. Further, a substantially flat set plate 13 is positioned in contact relationship with the rear surface of the contact arm 11. The front end of the magazine 5 is fixed to the rear surface of the set plate 13. The set plate 13 has an upper end fixed to mounting bases 2*b* formed on the body 2 by means of bolts 14, so that the set plate 13 extends downwardly from the body 2. The mounting bases 2*b* are formed integrally with the lower end of the body 2 and protrude downwardly therefrom.

Figure 4:
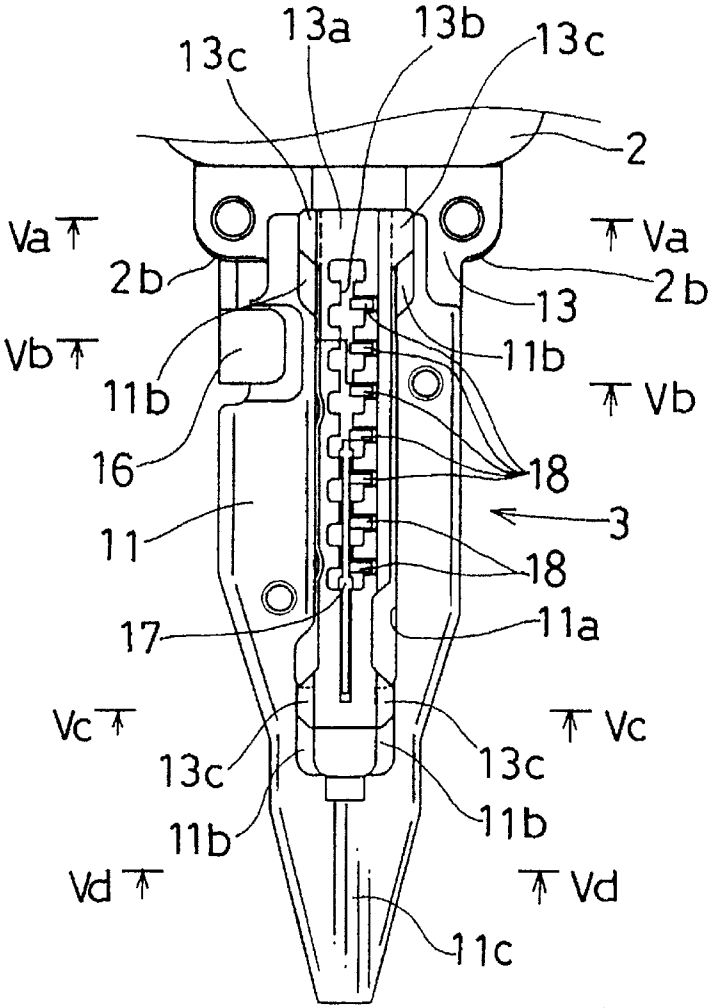
FIG. 4 is a view similar to FIG. 3, with a driver guide removed.
Figure 5A:
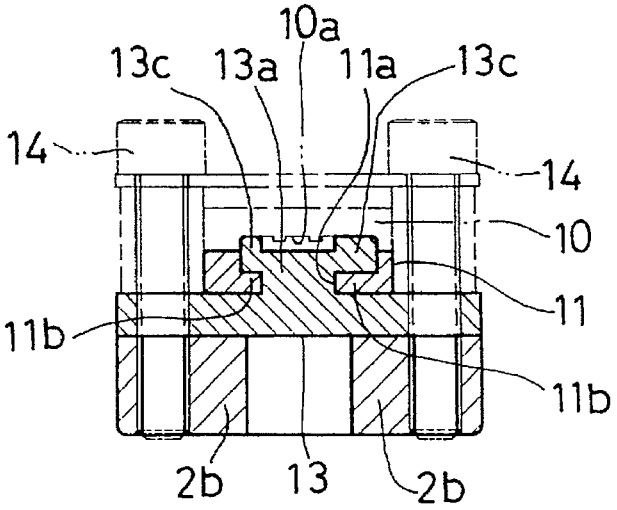
FIG. 5(*a*) is a sectional view taken along line Va—Va in FIG. 4.
Figure 5B:
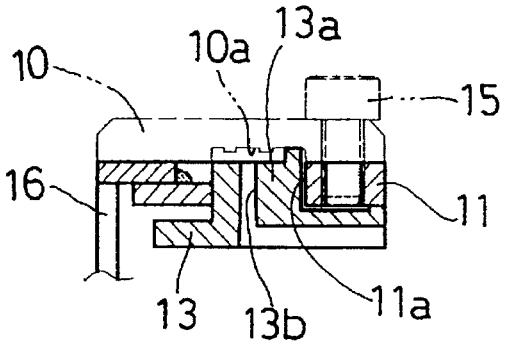
Figure 5C:
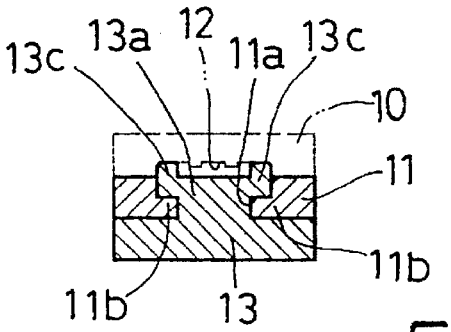
Figure 5D:
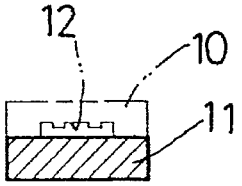

As shown in FIGS. 4 and FIGS. 5(*a*) to 5(*d*), a block-like support protrusion 13*a* is formed integrally with the set plate 13 on the front side thereof. The support protrusion 13*a* has a longitudinal axis in a longitudinal direction of the set plate 13. A hall insertion hole 13*b* having an elongated configuration in the vertical direction is formed in the support protrusion 13*a* and extends throughout the thickness of the set plate 13, so that the interior of the magazine 5 for storing the nails is in communication with the front side of the set plate 13 through the insertion hole 13*b*. As best shown In FIG. 4, a plurality of recesses are formed on both lateral sides of the insertion hole 13*b* so as to receive heads of the nails having different lengths and to receive a plurality of hall guide rods 18 which are mounted on the magazine 5 at different heights. Two pairs of support tabs 13*c* are formed on an upper end and a lower end of the support protrusion 13*a*, respectively, and extend laterally outwardly from the protrusion 13*b* on both lateral sides, so that a gap is formed between each of the support tabs 13*c* and the front surface of the set plate 13. A hole 11*a* is formed in the contact arm 11 and extends along the central axis of the contact arm 11. The hole 11*a* has an open upper end and a closed lower end. Two pairs of thin plate portions 11*b* are formed integrally with the contact arm 11 and are positioned on an upper end and a lower end of the hole 11*a*, respectively. Each pair of the thin plate portions 11*b* are positioned on both lateral sides of the hole 11*a* and protrude inwardly therefrom, respectively. The contact arm 11 is positioned in face-to-face relationship with the set plate 13 such that the hole 11*a* receives the support protrusion 13*a* and that the plate portions 11*b* are positioned within their corresponding gaps formed between the set plate 13 and support tabs 13*c* of the support protrusion 13*a*, so that the contact arm 11 is movable vertically relative to the set plate 13 by a predetermined distance. The driver guide 10 is positioned in face-to-face relationship with the front surface of the contact arm 11 and is fixed to the contact arm 11 by means of bolts 15 in such a manner that the lower end of the driver guide 10 is positioned at the same height as the lower end of the contact arm 11.

As shown in FIG. 5(*a*), a guide recess 10*a* is formed on the rear surface of the driver guide 10 which confronts the contact arm 11. The guide recess 10*a* extends throughout the length of the driver guide 10 in the longitudinal direction thereof. As shown in FIG. 5(*b*), the nail insertion hole 13*b* of the support protrusion 13*a* is in communication with the guide recess 10*a*. Thus, the guide recess 10*a* is in communication with the interior of the magazine 5 through the nail insertion hole 13*b*. A part of the guide recess 10*a* positioned downwardly of the nail insertion hole 13*b* confronts a flat lower portion 11*c* (see FIG. 4) of the contact arm 11 so as to form the nail driving passage 12 for guiding the nails when the nails are driven into the work. Thus, the nail driving passage 12 is formed between the driver guide 10 and the contact arm 11 which are fixed together such that their lower ends are positioned at the same height with each other. Further, the driver guide 10 as well as the contact arm 11 is movable vertically relative to the set plate 13 under the guide of the set plate 13. Therefore, even if the upper stroke end of the driver guide 10 has been varied for adjustment of the driving depth of the nails, the lower ends of the driver guide 10 and the contact arm 11 are held at the same height with each other, so that the nail driving passage 12 is held to extend to the lower end of the driver guide 10.

As shown in FIG. 4, a pusher plate 17 is disposed within the magazine 5 and serves to push the nails stored in series within the magazine 5 toward the guide recess 10*a* by a predetermined pitch corresponding to a distance between two adjacent nails, so that the nails are fed into the guide recess 10*a* one after another as the driver 7 is driven to be moved downwardly. The nail guide rods 18 are mounted on a cover of the magazine 5 and are positioned at different heights in response to various nails having different lengths. The whole magazine 5 including the pusher plate 17 and the nail guide rods 18, etc. are shown in FIG. 1.

Figure 2:
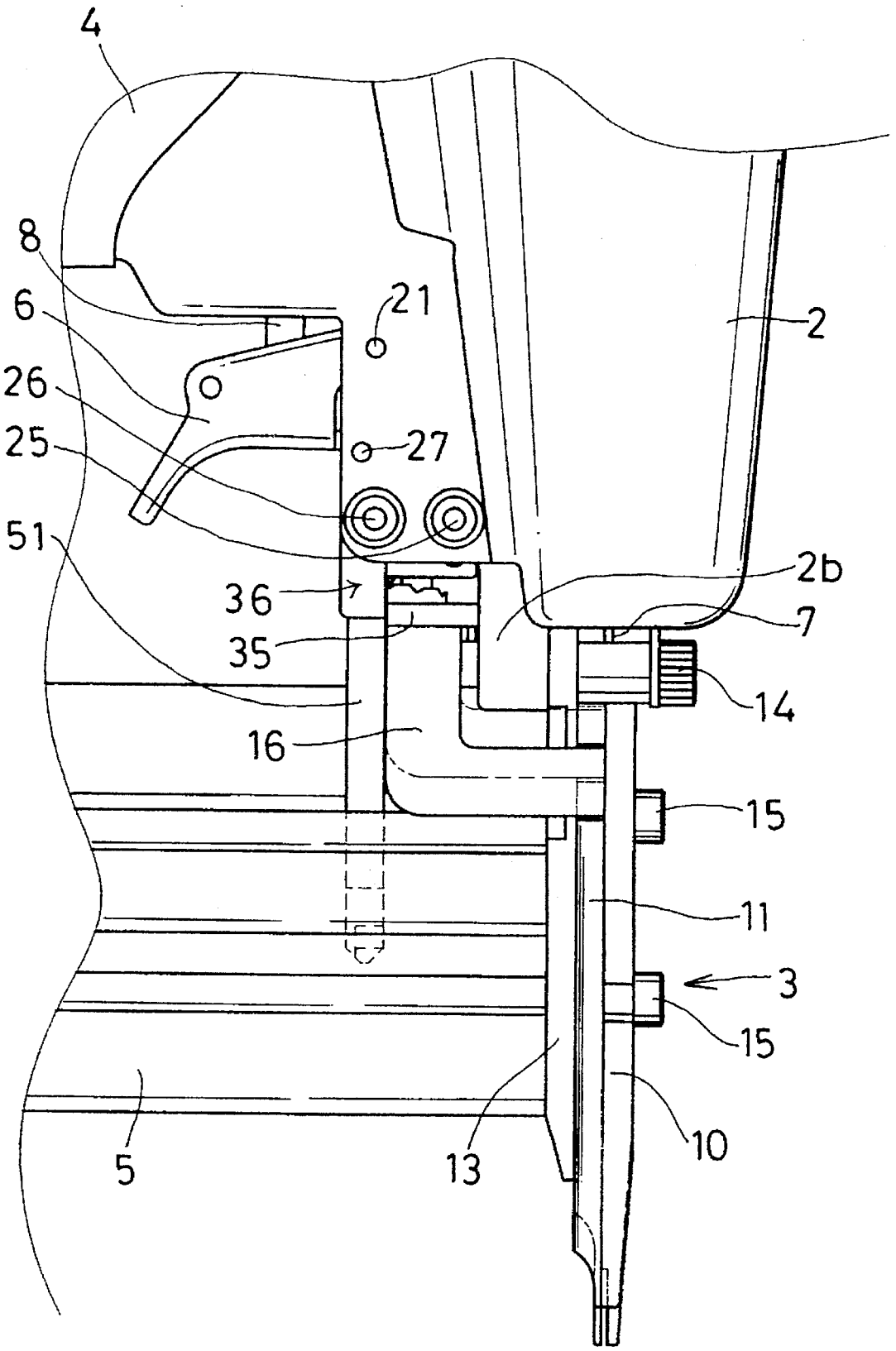
FIG. 2 is right side view of a front portion of the nailing machine.
Figure 3:
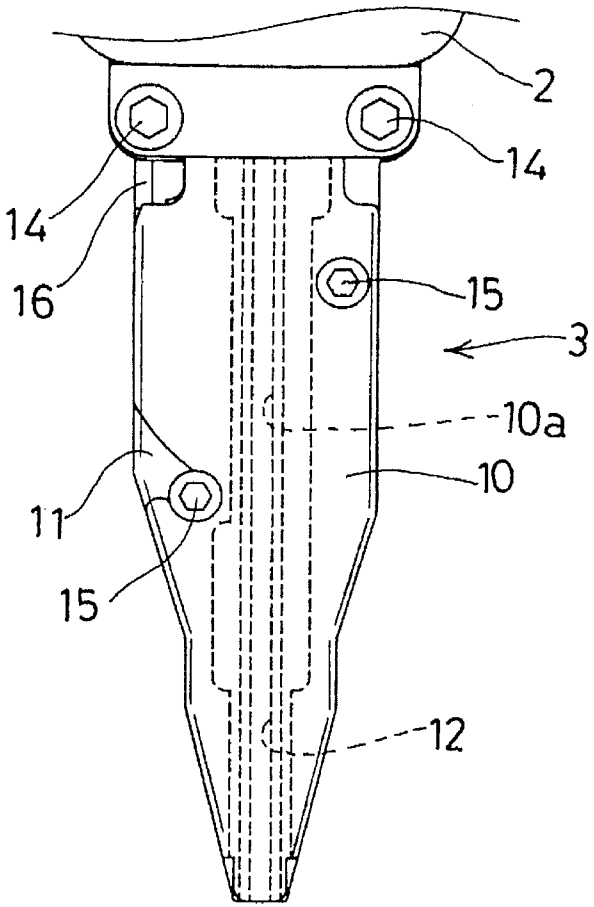
FIG. 3 is a front view of the front portion of the nailing machine.

As shown in FIGS. 2, 4 and 5(*b*), a connecting arm 16 is fixed to the upper portion of the contact arm 11, so that the connecting arm 11 is movable vertically together with the contact arm 16. As shown in FIG. 2, the lower portion of the connecting arm 16 has an L-shaped configuration so as to detour one of the mounting bases 2*b* at its lower position. The upper portion of the connecting arm 16 is connected to a stopper 24 of a trigger control device 20. In response to the vertical movement of the stopper 24, the trigger control device 20 is operable to prevent and permit the trigger valve 8 to be opened when the trigger 6 is turned on. More specifically, the trigger valve 8 may not be opened to move the piston 3 for driving the nails unless the contact arm 11 is pressed on the work so as to be moved upwardly. The construction of the trigger control device 20 will be explained later.

Figure 6:
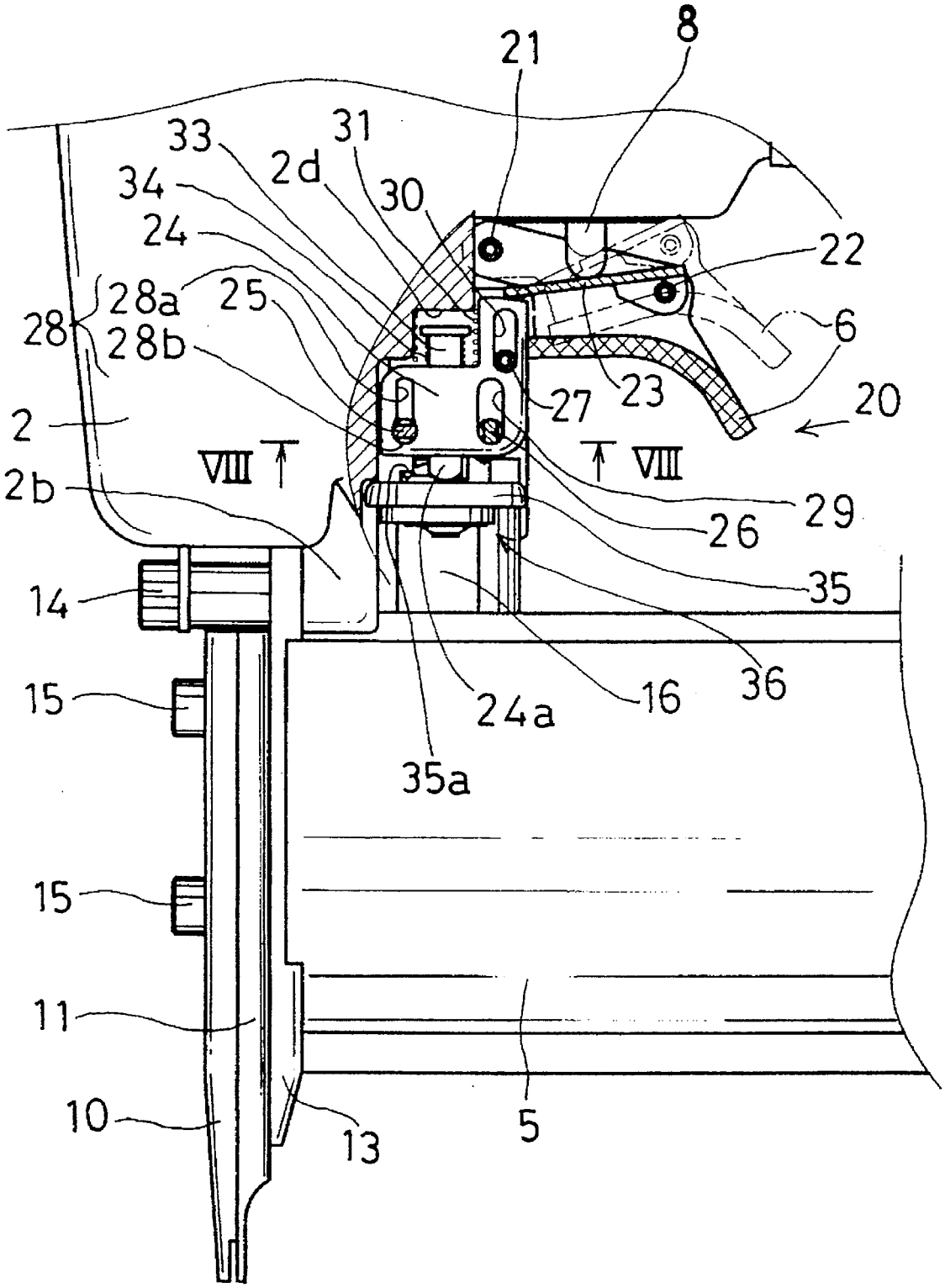
FIG. 6 is a left side view, with a part broken away, of the front portion of the nailing machine where the nailing machine is set to drive nails at greatest driving depth.
Figure 7:
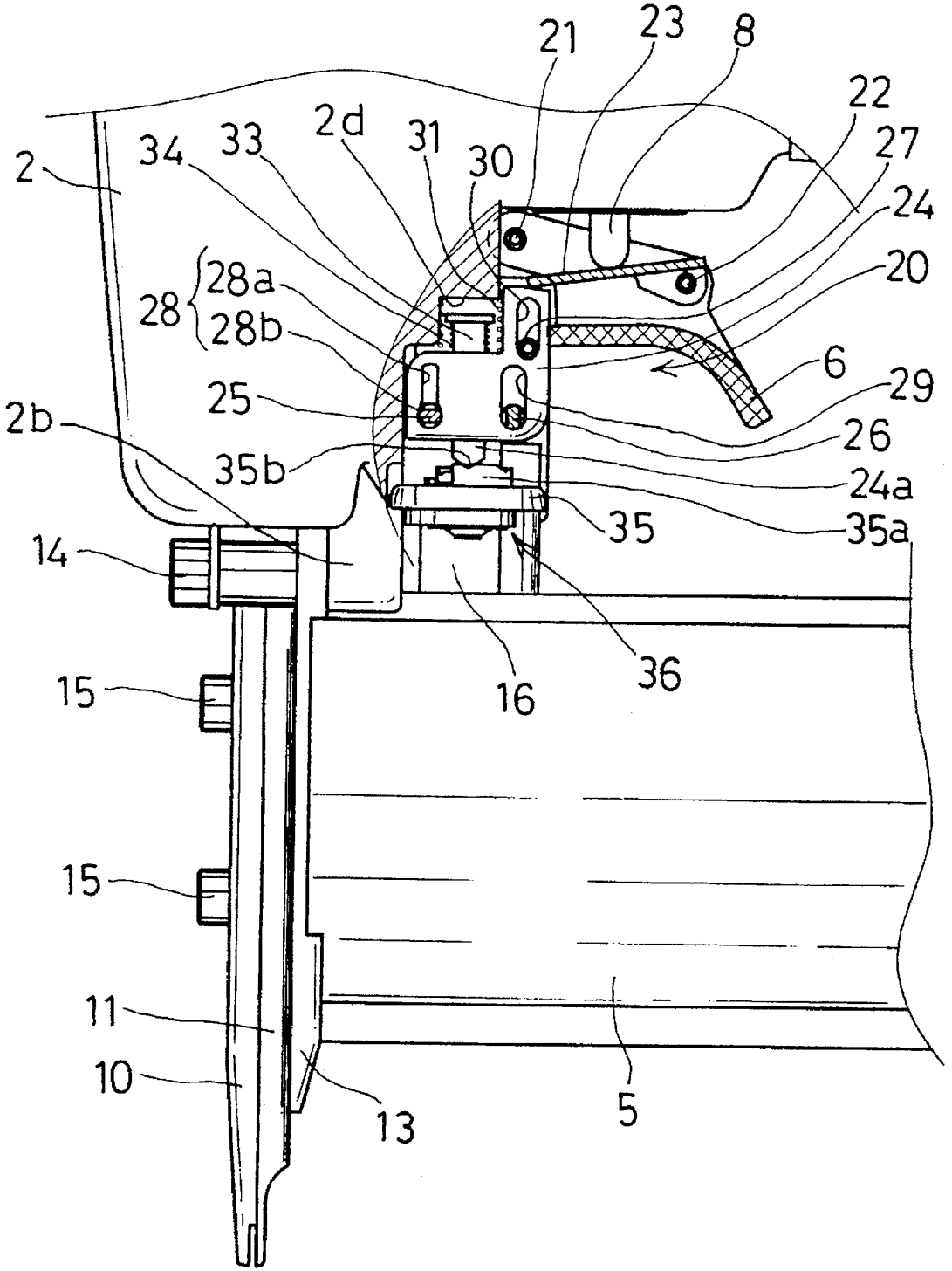
FIG. 7 is a view similar to FIG. 6 but showing the nailing machine set to drive the nails at shortest driving depth.
Figure 8:
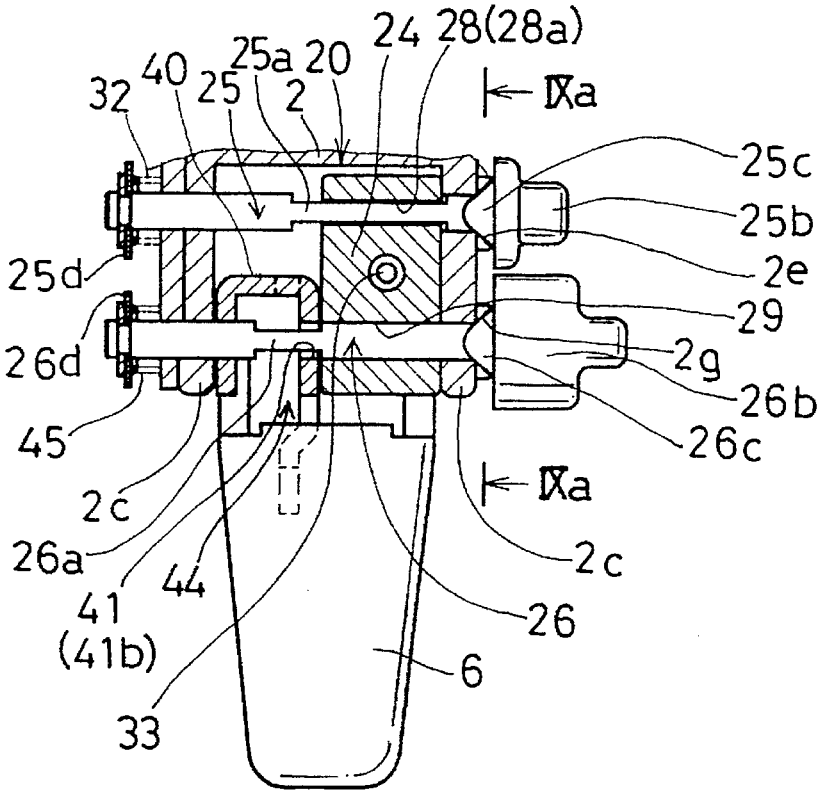
FIG. 8 is a sectional view taken along line VIII—VIII in FIG. 6.
Figure 9A:
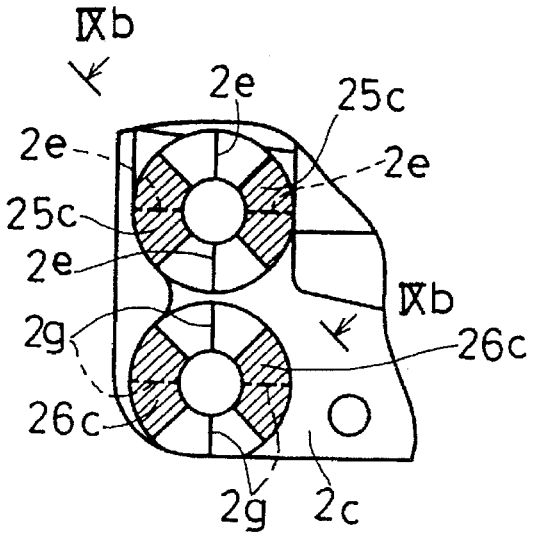
FIG. 9(*a*) is a sectional view taken along line IXa—IXa in FIG. 8.
Figure 9B:
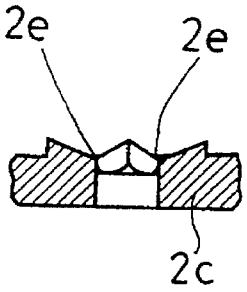

As shown in FIGS. 6 to 8, a pair of parallel support wall portions 2*c* are formed on the rear side of the body 2 at a position adjacent the lower end of the body 2. The support wall portions 2*c* extend outwardly from the body 2 so as to receive the front portion of the trigger 6 therebetween. The front portion of the trigger 6 is vertically pivotally mounted on the support walls 2*c* by means of a support pin 21 as shown in FIG. 6. An idler plate 23 is vertically pivotally mounted on the trigger 6 by means of a support pin 22 and confronts the trigger valve 8. With the stopper 24 positioned at its upper stroke end shown in FIG. 6, the trigger valve 8 is opened by the idler plate 23 through the pulling operation of the trigger 6. When the operator releases the trigger 6, the trigger 6 and the idler 23 is pivoted to return to their original positions by the biasing force of the trigger valve 8.

As shown in FIG. 8, between the support wall portions 2*c*, the stopper 24 and a link 40 are positioned in juxtaposed relationship with each other. The link 40 is bent to have a substantially U-shaped configuration in section. More specifically, an arm lock pin 25, a trigger lock pin 26 and a support pin 27 extend across the support wall portions 2*c*. The pins 25, 26 and 27 are positioned in parallel to and in spaced relationship by a predetermined distance from each other. The stopper 24 is supported by all the pins 25, 26 and 27 (see FIG. 6), while the link 40 is supported by the trigger lock pin 26 and the support pin 27 (see FIG. 12). Each of the pins 25 and 26 is pivotable around its own axis relative to the support wall portions 2*c* and is movable in the vertical direction relative thereto. The support pin 27 is a spring-biased pin and is fixed in position relative to the support wall portions 2*c*.

The stopper 24 has insertion holes 28, 29 and 30 for insertion of the pins 25, 26 and 27, respectively. The link 40 has insertion holes 41 and 42 for insertion of the trigger lock pin 26 and the support pin 27, respectively. Thus, the arm lock pin 25 is inserted into the insertion hole 28 of the stopper 24, the trigger lock pin 26 is inserted into the insertion hole 29 of the stopper 24 and the insertion hole 41 of the link 40, and the support pin 27 is inserted into the insertion hole 30 of the stopper 24 and the insertion hole 42 of the link 40. Each of the insertion holes 28, 29 and 30 formed in the stopper 24 and the insertion holes 41 and 42 formed in the link 40 has an elongated configuration in the vertical direction, so that the stopper 24 and the link 40 are vertically movable independently of each other by a predetermined distance. Here, the insertion holes 29, 30 and 42 have simple elongated configurations. On the other hand, the insertion holes 28 and 41 have unique configurations as will be explained later.

Figure 12:
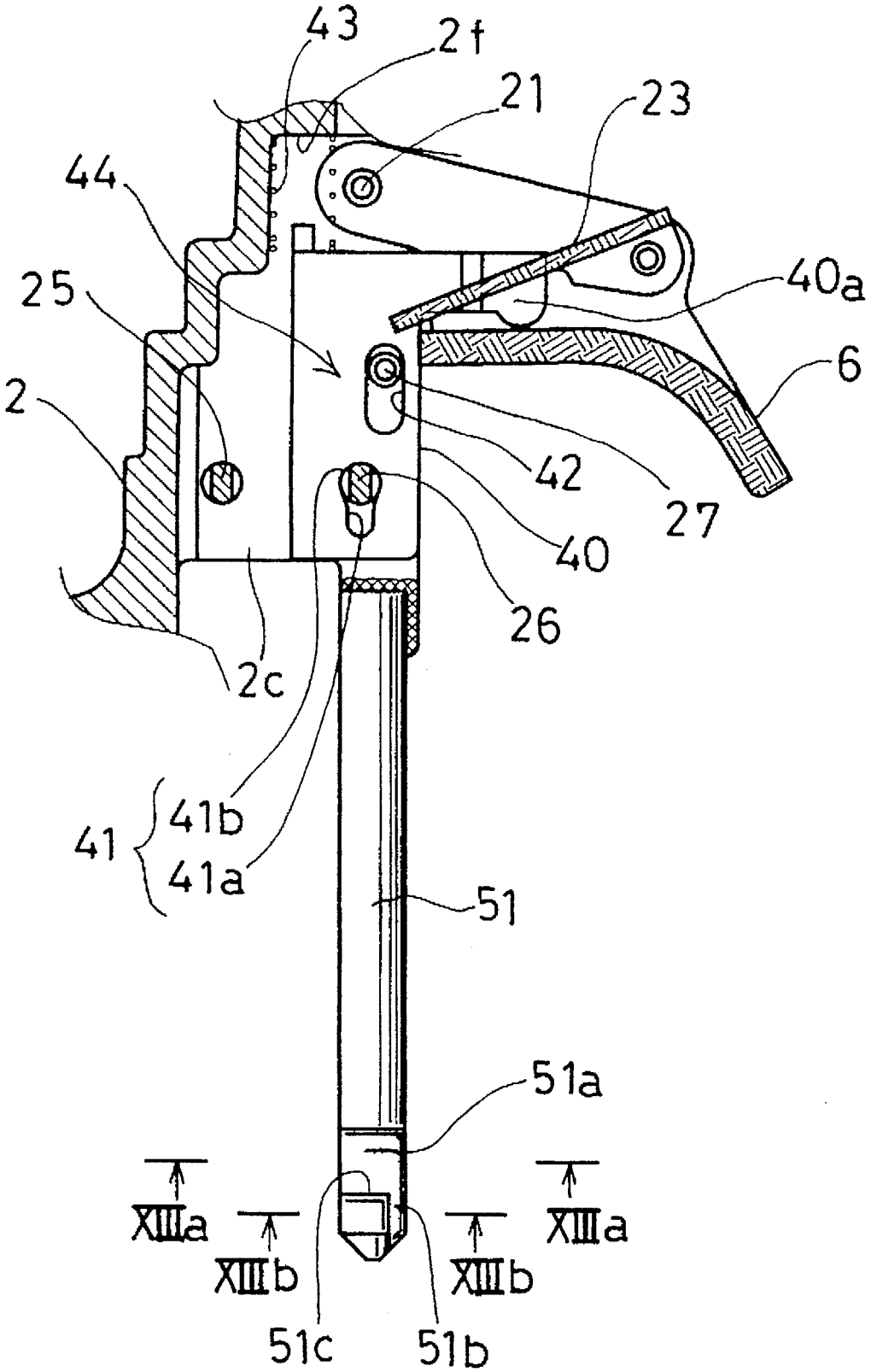
FIG. 12 is a left side view of a trigger lock device of the nailing machine.

As shown in FIGS. 6 and 7, a compression coil spring 31 is interposed between the stopper 24 and a wall portion 2*d* formed on a part of the body 2 between the support wall portions 2*c*, so that the stopper 24 is normally biased in the downward direction. Further, as shown in FIG. 12, a compression coil spring 43 is interposed between the link 40 and a wall portion 2*f* formed on the body 2 at a position different from the wall portion 2*d*, so that the link 40 is also normally biased in the downward direction. The link 40 constitutes a part of a trigger lock device 44 which will be explained later.

The connecting arm 16 fixed to the contact arm 11 is connected to the stopper 24 which is vertically movably supported as described above, via a driving depth adjusting device 36. Thus, when the contact arm 11 is moved upwardly, the stopper 24 is moved upwardly against the biasing force of the compression coil spring 31. When the contact arm 11 has been released, the stopper 24 as well as the contact arm 11 is moved downwardly by the biasing force of the coil spring 31. In other words, the contact arm 11 is moved upwardly against the biasing force of the compression coil spring 31 and is moved downwardly by the biasing force of the same.

Figure 11:
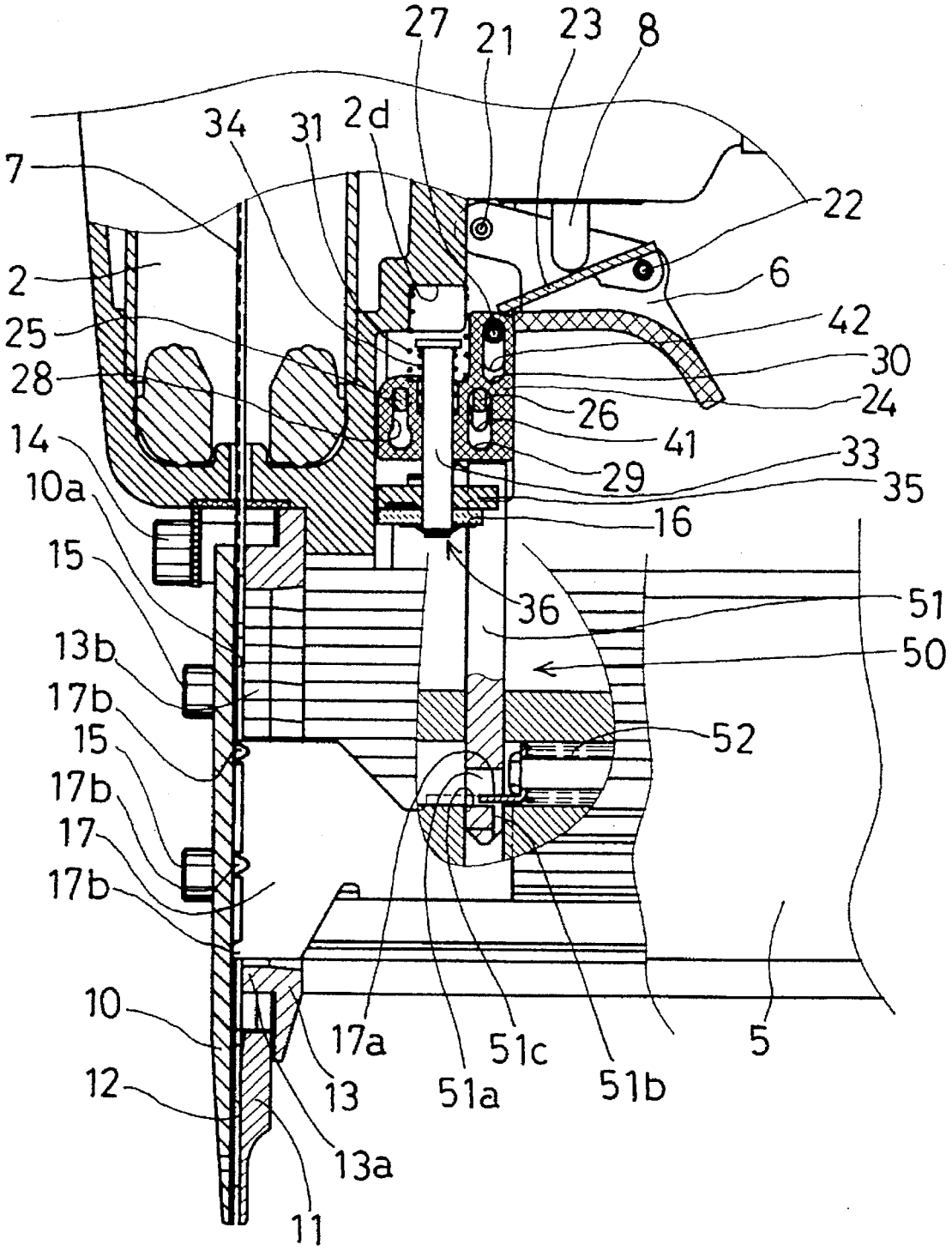
FIG. 11 is a view similar to FIGS. 6 and 7 but showing the essential parts of an idle driving prevention device of the nailing machine.

When the stopper 24 as well as the contact arm 11 is moved upwardly to its upper stroke end shown in FIG. 6, the idler 23 is pivoted upwardly to each a position adjacent the trigger valve 8. At this stage, when the trigger 6 is pulled, the trigger valve 8 is opened by the idler 23, so that the operation of the trigger 6 is effectively performed. On the other hand, when the trigger 6 is pulled with the stopper 24 held in its lowermost position as shown in FIG. 11 (where the contact arm 11 is not pressed on the work), the forward end of the idler 23 is moved rearwardly away from the upper surface of the stopper 24 as the support pin 22 is moved upwardly. Thus, the idler 23 is moved away from the trigger valve 8, and therefore, in this case, the trigger valve 8 is not opened even if the trigger 6 has been pulled. This means that the pulling operation of the trigger 6 is canceled. The pulling operation of the 6 to open the trigger valve 8 is therefore effective only when the contact arm 11 is moved upwardly to its upper stroke end. This is the essential function of the trigger control device 20.

As best shown in FIG. 8, a part 25*a* of the arm lock pin 25 which is positioned within the insertion hole 28 does not have a cylindrical configuration but has a flat plate-like configuration. On the other hand, as shown in FIG. 6, the insertion hole 28 has an elongated portion 28*a* and a circular portion 28*b* formed in series with the lower end of the elongated portion 28*a*. The circular portion 28*b* has a diameter slightly greater than the diameter of the arm lock pin 25. The elongated portion 28*a* has a width smaller than the diameter of the lock pin 25 but slightly greater than the width of the flat plate-like part 25*a*. Therefore, with the flat plate-like part 25*a* positioned within the circular portion 28*b* or with the stopper 24 positioned at its upper stroke end, when the arm lock pin 25 is rotated to a lock position where the flat plate-like part 25*a* is in a horizontal position or is positioned perpendicular to the elongated portion 28*a* as shown in FIG. 6, the flat plate-like part 25*a* cannot be moved to enter the elongated portion 28*a*. Thus, the stopper 14 is locked at the upper stroke end and is prevented from moving downwardly. When the arm lock pin 25 is rotated from the lock position by an angle of 90°, the flat plate-like part 25*a* is positioned vertically in alignment with the elongated portion 28*a*, so that the flat plate-like part 25*a* is permitted to enter the elongated portion 28*a*. Then, the stopper 31 is moved downwardly by the biasing force of the compression coil spring 31.

Further, as shown in FIG. 8, the arm lock pin 25 has a left side end which extends outwardly from the left side support wall portion 2*c* and which has a stopper ring 25*d* fixed thereto. A compression coil spring 32 is interposed between the stopper ring 25*d* and the left side support wall portion 2*c*, so that the arm lack pin 25 is normally biased in the leftward direction. On the other hand, a knob 25*b* is mounted on the right side end of the arm lock pin 25 which extends outwardly from the right side support wall portion 2*c*. The knob 25*b* has a left side surface on which a pair of engaging protrusions 25*c* are formed in opposed relationship with each other or in spaced relationship with each other by an angle of 180°. Each of the engaging protrusions 25*c* has a substantially triangular configuration having an apex directed leftwardly. Four engaging recesses 2*e* for engagement with the engaging protrusions 25*c* are formed on the right side surface of the right side support wall portion 2*c* and are spaced from each other by an angle of 90°. Each of the engaging recesses 2*e* has a substantially V-shaped configuration in section. With this construction, since the arm lock pin 25 is biased in the leftward direction in FIG. 8 or the direction for engagement of the engaging protrusions 25*c* with the engaging recesses 2*e*, the arm lock pin 25 is held in position upon rotation by each angle of 90° through engagement between the engaging protrusions 25*c* and their corresponding two engaging recesses 2*e* opposed to each other. Therefore, the flat plate-like part 25*a* can be reliably held in any of the vertical and horizontal positions.

Here, when the flat plate-like part 25*a* is held in the horizontal position to fix the stopper 24 at its upper stroke end, the trigger 6 is effectively operated to open the trigger valve 8 without moving the contact arm 11 upwardly through pressing on the work. Thus, such a locking operation of the stopper 24 at its upper stroke end serves to release the trigger control device 20. This may permit to efficiently and readily perform an operation called "dragging nail driving operation" or "continuous nail driving operation" often performed at a working place, so that the operability of the nailing machine 1 is greatly improved.

Figure 10:
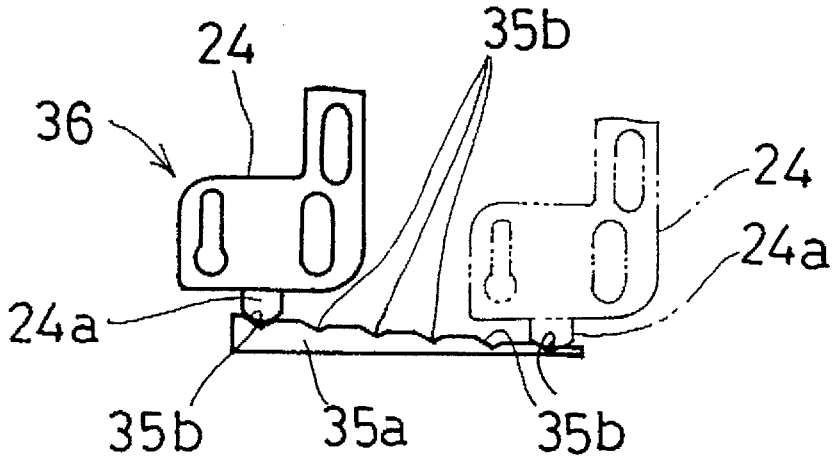
FIG. 10 is a view showing the essential parts of a driving depth adjusting device of the nailing machine with a protrusion of a stopper being in engagement with cam recesses having different heights.

The driving depth adjusting device 36 will now be explained. As shown in FIG. 6, a headed pin 33 is vertically slidably inserted into the stopper 24 and is normally biased upwardly by a compression spring 34 interposed between a head of the pin 33 and the stopper 24. The lower portion of the pin 33 extends downwardly from the lower end of stopper 24. A disc-like adjustor 35 is rotatably mounted on the pin 33 at a position adjacent the lower end of the pin 33. The adjustor 35 is fixed in position relative to the pin 33 in an axial direction of the pin 33. As shown in FIG. 10 in developed form, a cylindrical cam 35*a* is formed integrally with an upper surface of the adjustor 35. The cylindrical cam 35*a* has an upper end on which a plurality of V-shaped cam recesses 35*b* are formed in the circumferential direction in spaced relationship with each other by a predetermined distance. The heights of the cam recesses 35*b* from the upper surface of the adjustor 35 are varied gradually in the circumferential direction. On the other hand, a protrusion 24*a* having a substantially triangular lower end is formed on the lower surface of the stopper 24 for engagement with the cam 35*a*. With this construction, as the adjustor 35 is rotated, the protrusion 24*a* in turn engage the higher or lower cam recess 35*b*, so that the vertical position of the headed pin 33 as well as the vertical position of the adjustor 24 relative to the stopper 24 is gradually changed.

As the vertical position of the headed pin 33 relative to the stopper 24 is thus varied, the vertical position of the connecting arm 16 connected to the headed pin 33 is varied relative to the stopper 24, so that the position of stroke movement of the driver guide 10 fixed to the contact arm 11 is varied. More specifically, as shown in FIG. 7, when the adjustor 35 is rotated to a position where the protrusion 24*a* engages the highest cam recess 35*b* (as indicated by solid lines in FIG. 10), the headed pin 33 is moved downwardly relative to the stopper 24, so that the position of the stroke movement of the driver guide 10 is moved downwardly and so that the upper stroke end of the driver guide 10 is moved downwardly. Since the stroke of the driver 7 is invariable, the stroke of the nails driven by the driver 7 becomes shorter, and consequently, the driving depth of the nails becomes shorter. In contrast, when the protrusion 24*a* is moved to engage the lower cam recess 35*b*, the headed pin 33 is moved upwardly relative to the stopper 24, so that the position of the stroke movement of the driver guide 10 is moved upwardly and so that the upper stroke end of the driver guide 10 is moved upwardly. The driving depth becomes greater as the upper stroke end is moved upwardly. Thus, the driving depth is greatest when the protrusion 24*b* is in engagement with the lowermost cam recess 35 as shown by chain lines in FIG. 10. The range of adjustment of the driving depth therefore coincides with the difference of height between the highest cam recess 35*b* and the lowest cam recess 35*b*. Consequently, the driving depth of the nails can be adjusted by rotating the adjustor 35 to vary the upper stroke end of the driver guide 10.

The construction of the trigger lock device 44 will now be explained. The trigger lock device 44 serves to directly lock the trigger 6 not to be pulled by the operator, so that an accidental driving of nails can be prevented when the nails are not to be driven. As described above, the link 40 constitutes the element of the trigger lock device 44 and includes the insertion holes 41 and 42 for insertion of the trigger lock pin 26 and the support pin 27. Further, the link 40 is vertically movably supported between the support wall portions 2*c* and is biased by the compression coil spring 43 in the downward direction.

As shown in FIG. 12, the insertion hole 42 for insertion of the support pin 42 has an elongated configuration similar to the insertion hole 30 of the stopper 24. On the other hand, the insertion hole 41 for insertion of the trigger lock pin 26 has an elongated portion 41*a* and a circular portion 41*b* similar to the insertion hole 28 of the stopper 24. However, in contrast to the insertion hole 28, the circular portion 41*b* is positioned at the upper end of the elongated portion 41*a*. Further, the link 40 has an upper end which extends horizontally toward the trigger 6 and which includes an engaging tab 40*a* positioned on the back side of the trigger 6. The engaging tab 40*a* is normally pressed on the back surface of the trigger 6 by the biasing force of the compression coil spring 43, so that the trigger 6 cannot be pulled or cannot be moved from the OFF position to the ON position unless the engaging tab 40*a* is permitted to be moved upwardly or is not fixed in position as will be explained later. In addition to the returning force of the trigger valve 8, the biasing force of the compression spring 43 applied to the trigger 6 via the engaging tab 40*a* also serves to return the trigger 6 to the OFF position.

As shown in FIG. 8, a part 26*a* of the trigger lock pin 26 inserted into the insertion hole 41 has a flat plate-like configuration similar to the part 25*a* of the arm lock pin 25. The trigger lock pin 26 has a left side end which extends outwardly from the left side support wall portion 2*c* and which has a stopper ring 26*d* fixed thereto. A compression coil spring 45 is interposed between the stopper ring 36*d* and the left side support wall portion 2*c* so as to normally bias the trigger lock pin 26 in the leftward direction. The trigger lock pin 26 has a right side end which extends outwardly from the right side support wall portion 2*c* and which has a knob 26*b* mounted thereon. The knob 26*b* has a left side surface on which a pair of engaging protrusions 26*c* are formed in opposed relationship with each other or in spaced relationship with each other by an angle of 180°. Each of the engaging protrusions 26*c* has a substantially triangular configuration having an apex directed leftwardly. Four engaging recesses 2*g* for engagement of the engaging protrusions 26*c* are formed on the right side surface of the right side support wall portion 2*c* and are spaced from each other by an angle of 90°. Each of the engaging recesses 2g has a substantially V-shaped configuration in section. With this construction, when the trigger lock pin 26 is rotated with the knob 26b grasped by the operator, the trigger lock pin 26 is held in position upon rotation by each angle of 90° through engagement between the engaging protrusions 26c and their corresponding two engaging recesses 2g opposed to each other. Therefore, the flat plate-like part 26a can be reliably held in any of the vertical and horizontal positions. When the flat plate-like part 25a is held in the horizontal position, the link 40 cannot be moved upwardly, so that the trigger 6 cannot be pulled to open the trigger valve 8 or the trigger 6 is locked not to be pulled. When the knob 26b is rotated by an angle of 90° to move the flat plate-part 25a to the vertical direction, the link 40 can be moved vertically against the biasing force of the compression spring 43, so that the trigger 6 can be switched from the OFF position to the ON position. Thus, the trigger lock is released.

Figure 13A:
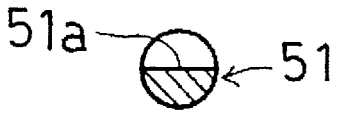
FIG. 13(*a*) is a sectional view taken along line XIIIa—XIIIa in FIG. 12.
Figure 13B:
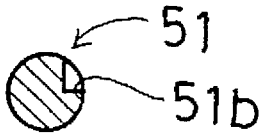

With the nailing machine 1 of this embodiment, an idle driving prevention device 50 is interlocked with the trigger lock device 44. As shown in FIG. 12, a stopper bar 51 is fixed to the lower end of the link 40 and extends downwardly therefrom. The stopper bar 51 has a lower portion which is inserted into the magazine 5 as shown in FIG. 11. A forward and a rearward cut-out recess 51a and 51b are formed on the lower portion of the stopper bar 51. The forward and the rearward cut-out recesses 51a and 51b are formed on the left side of the stopper bar 51 but have different configurations from each other. As shown in FIG. 13(*a*), the forward cut-out recess 51a has a substantially semicircular configuration in section and extends by a predetermined distance in an axial direction of the stopper bar 51, so that the forward cut-out recess 51a is spaced from the lower end of the stopper bar 51. As shown in FIG. 13(*b*), the rearward cut-out recess 51b has a substantially quadrant configuration in section and is formed in series with the forward cut-out recess 51a. The rearward cut-out recess 51b extends downwardly to reach the lower end of the stopper bar 51.

On the other hand, as shown in FIG. 11, the pusher plate 17 disposed within the magazine 5 is biased by a compression spring 52 in the forward direction for pressing the nails stored in the magazine 5 toward the guide recess 10a of the driver guide 10. Thus, the pusher plate 17 is gradually moved forwardly as the number of the nails Within the magazine 5 is reduced through driving operation of the nails one after another. When the number of the nails remaining within the magazine 5 is reduced to one, an engaging plate 17a mounted on the rear end of the pusher plate 17 is brought to enter the rearward cut-out recess 51b. Since the rearward cut-out recess 51b extends to the lower end of the stopper bar 51, the engaging plate 17a does not serve to prevent the stopper bar 51 from moving upwardly. Thus, at this stage, the trigger 6 can be pivoted from the OFF position to the ON position. When the last nail has been driven into the work, with a result that no nail exists within the guide recess 10a of the driver guide 10, the pusher plate 17 is further moved forwardly, so that the engaging plate 17a enters the forward cut-out recess 51a. As described above, the forward cut-out recess 51a extends in the axial direction of the stopper bar 51 not to reach the lower end of the stopper bar 51. Therefore, when the engaging plate 17a enters the forward cut-out recess 51a, the upward movement of the stopper bar 51 is prevented by the engaging plate 17a through abutment of the engaging plate 17a on an lower wall 51c of the forward cut-out recess 51a. Consequently, the link 40 is prevented from moving upwardly, and therefore, the trigger 6 is locked not to be pivoted from the OFF position to the ON position irrespective of non-operation of the trigger lock device 44. The idle driving of the driver 7 is thus prevented when no nails exist in the magazine 6.

The operation and effect of the nailing machine I of this embodiment will now be explained.

When the lower end of the contact arm 11 of the trigger control device 20 is pressed on the wok, the contact arm 11 is moved upwardly to effectuate the operation of the trigger 6. Since the driver guide 10 is fixed to the contact arm 11 in face-to-face relationship with each other and has the lower end positioned at the same height as the lower end of the contact arm 11, the driver guide 10 is moved upwardly together with the contact arm 11 and is moved downwardly together with the contact arm 11 with the lower end of the driver guide 10 held at the same height as the lower end of the contact arm 11.

On the other hand, when the adjustor 35 is rotated to vary the driving depth of the nails, the driver guide 10 changes its height relative to the stopper 24. With this operation, since the upper stroke end of the stopper 24 is invariable, the upper stroke end of the driver guide 10 is varied. This results in variation in the distance between the work and the nail insertion hole 13b forming a nail supply hole at the time the contact arm 11 is moved to the upper stroke end through pressing on the work. With the variation in such a distance, since the stroke of the driver 7 is invariable, the stroke of the nails driven by the driver 7 is varied, so that the driving depth of the nails is varied. Further, since the driver guide 10 and the contact arm 11 is fixed to each other with their lower ends positioned at the same height as described above, the lower ends of the driver guide 10 and the contact arm 11 are held at the same height irrespective of variation of the upper stroke end of the driver guide 10.

Consequently, irrespective of the upward movement of the contact arm 11 through pressing on the work for effectuating the operation of the trigger 6, the lower ends of the driver guide 10 and the contact arm 11 are held at the same height with each other. Thus, this embodiment does not involve the difference between the heights of the lower ends of the driver guide 10 and the contact arm 11 which may be caused in the prior art nailing machine. Further, such a relationship between the lower ends of the driver guide 10 and the contact arm 11 is held irrespective of variation of the upper stroke end of the driver guide 10 for adjusting the driving depth. The nail driving passage 12 is therefore maintained to extend to the lower end of the driver guide 10, so that the nails can be reliably guided until they are driven into the work. This means that the nails are stably driven into the work at the aimed position.

Figure 14A:
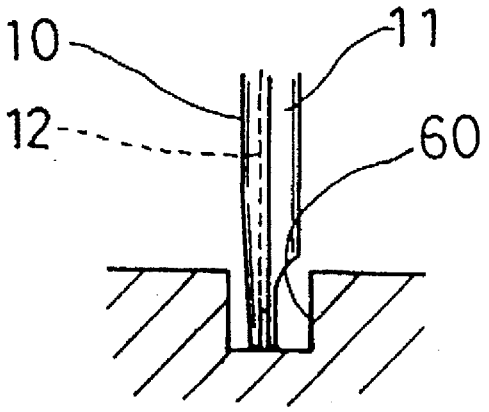
FIG.14(a) PRIOR ART
FIG. 14(*a*) is a view showing lower portions of a driver guide and a contact arm of the nailing machine which is inserted into a recess formed on a mopboard.
Figure 14B:
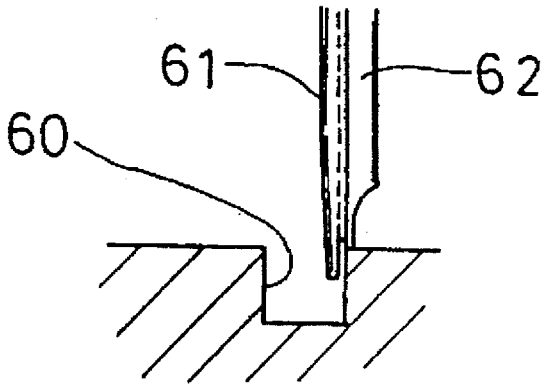
FIG.14(b) PRIOR ART

Additionally, in case that the nails are to be driven into a narrow recess 60 of a work such as a slidable mopboard shown in FIG. 14(*a*), the lower end of the driver guide 10 can be easily inserted into the recess 60 since the lower ends of the driver guide 10 and the contact arm 11 are held at the same height as described above. In contrast, as shown in FIG. 14(*b*), when lower ends of a contact arm 61 and a driver guide 62 are positioned at different heights from each other as in the prior art nailing machine, the lower end of the driver guide 62 is liable to be hitched on the periphery of the recess 60 when inserted. Therefore, the prior art nailing machine cannot be conveniently operated.

Further, when the lower ends of the contact arm 61 and the driver guide 62 are positioned at different heights from each other as in the prior art, since a contacting surface between the nailing machine and the work is small, the work may be damaged by the nailing machine. In case of the nailing machine 1 of the present invention, both the lower ends of the driver guide 10 and the contact arm 11 abut on the work, so that a greater contacting surface can be provided in comparison with the contacting surface as provided in the prior art. Thus, the abutting force is dispersed the on the greater contacting surface, so that work may not suffer substantial damage from the nailing machine 1.

Furthermore, with the prior art nailing machine, since the contact arm 61 normally extends downwardly from the driver guide 62, it is difficult to position the driver guide 62 for driving the nails at an aimed position. However, with the present invention, since the lower ends of the driver guide 10 and the contact arm 11 are positioned at the same height, the driver guide 10 can be reliably positioned for driving the nails at the aimed position.

While the invention has been described with reference to a preferred embodiment thereof, it is to be understood that modifications or variation may be easily made without departing from the spirit of this invention which is defined by the appended claims.

What is claimed is:

1. A nailing machine comprising:

a body;

a driver extending from said body and vertically reciprocally movable for driving nails in a driving direction;

a driver guide for guiding said driver;

a contact arm mounted to said body for movement relative to said body between a first position and a second position in a direction parallel to the driving direction of said driver, said contact arm having one end for abutment on a work;

said driver guide and said contact arm cooperating with each other to form therebetween a nail driving channel through which the nails are driven into the work;

said driver guide and said contact arm mounted to said body for movement together from said first position to said second position when pressed against a work;

so that said driver guide having one end positioned substantially at the same position in the driving direction as said one end of the contact arm, and said nail driving channel extends to said one end of said contact arm.

2. The nailing machine as defined in claim 1 wherein said driver guide and said contact arm have substantially flat plate-like configurations, respectively, and are fixed together in face-to-face relationship with each other.

3. The nailing machine as defined in claim 2 further including:

a set plate fixed to said body for vertically slidably guiding said contact arm; and a magazine for storing the nails, said magazine having one end connected to said set plate for supplying the nails one after another into said driver guide, and wherein:

said set plate has a substantially flat plate-like configuration and confronts a rear surface of said contact arm; and said driver guide confronts a front surface of said contact arm.

4. The nailing machine as defined in claim 1 further including:

a trigger operable by an operator between an ON position for driving said driver and an OFF position for stopping said driver; and trigger control means interposed between said trigger and said contact arm and operable to permit driving of said driver when said trigger is moved from said OFF position to said ON position with said contact arm held in said second position.

5. The nailing machine as defined in claim 4 further including contact arm locking means for fixing said contact arm in said second position, so that the driver is driven by moving said trigger from said OFF position to said ON position.

6. The nailing machine as defined in claim 5 wherein:

said trigger control means includes a stopper vertically slidably supported by said body within a predetermined distance corresponding to the distance between said first position and said second position;

said contact arm is connected to said stopper; and said contact arm locking means is operable to fix the position of said stopper relative to said body.

7. The nailing machine as defined in claim 1 further including driving depth adjusting means for adjustment of the driving depth of the nails by varying said second position of said contact arm.

8. The nailing machine as defined in claim 4 further including driving depth adjusting means for adjustment of the driving depth of the nails by varying said second position of said contact arm; and wherein:

said trigger control means includes a stopper vertically slidably supported by said body within a predetermined distance corresponding to the distance between said first position and said second position;

said contact arm is connected to said stopper; and said driving depth adjusting means is interposed between said stopper and said contact arm and is operable to adjust the position of said contact arm relative to said stopper.

* * * * *